US007220340B2

(12) United States Patent
Best

(10) Patent No.: US 7,220,340 B2
(45) Date of Patent: May 22, 2007

(54) PAPER MACHINE CLOTHING AND METHOD FOR ITS MANUFACTURE

(75) Inventor: Walter Best, Duren (DE)

(73) Assignee: Heimbach Gmbh & Co., Duren (DE)

( * ) Notice: Subject to any disclaimer, the term of this patent is extended or adjusted under 35 U.S.C. 154(b) by 463 days.

(21) Appl. No.: 10/423,022

(22) Filed: Apr. 25, 2003

(65) Prior Publication Data

US 2004/0007281 A1 Jan. 15, 2004

(51) Int. Cl.
*D21F 7/12* (2006.01)
*D21F 7/08* (2006.01)
*D04H 3/04* (2006.01)

(52) U.S. Cl. ..... 162/358.2; 162/348; 162/900; 162/904; 428/58; 428/107; 428/109; 428/114; 428/131; 428/190; 428/193; 428/218; 428/220; 428/223; 428/347; 428/397; 442/320; 442/324; 442/326

(58) Field of Classification Search ..... 428/58, 428/107, 109, 114, 131, 190, 193, 218, 220, 428/223, 347, 397; 162/348, 358.2, 900, 162/904; 442/320, 324, 326
See application file for complete search history.

(56) References Cited

U.S. PATENT DOCUMENTS 3,097,413 A 7/1963 Draper, Jr.
3,818,519 A * 6/1974 Schuder ..... 5/411
4,250,822 A * 2/1981 Fickers ..... 112/475.17
4,395,308 A * 7/1983 Dawes ..... 162/232
4,555,440 A 11/1985 Crook
4,633,596 A * 1/1987 Josef ..... 34/116
5,079,807 A * 1/1992 Hood ..... 24/33 P
5,829,488 A * 11/1998 Fagerholm et al. ..... 139/383 A
5,840,637 A * 11/1998 Denton et al. ..... 442/361
5,888,915 A 3/1999 Denton et al.
6,331,341 B1 * 12/2001 Joyce ..... 428/138
6,630,223 B2 * 10/2003 Hansen ..... 428/131

(Continued)

FOREIGN PATENT DOCUMENTS

DE 1802560 8/1969

(Continued)

OTHER PUBLICATIONS

Dictionary definition of "locked", The American Heritage® Dictionary of the English Language, Fourth Edition Copyright © 2004, 2000 by Houghton Mifflin Company, no month.*

(Continued)

*Primary Examiner*—Andrew Piziali
(74) *Attorney, Agent, or Firm*—Berenato, White & Stavish, LLC

(57) ABSTRACT

The invention concerns a porous paper machine clothing (1) for dewatering a paper web in a paper machine, having a yarn layer made up of at least one ply (2) of longitudinal yarns (3) and at least one ply (4) of transverse yarns (5, 6, 7) that cross the longitudinal yarns (3), which is characterized in that the longitudinal and transverse yarns (3, 5, 6, 7) are connected positively to one another at crossing points (8). The invention further concerns a method for manufacturing a porous paper machine clothing of this kind.

24 Claims, 4 Drawing Sheets

U.S. PATENT DOCUMENTS 6,972,269 B1 * 12/2005 Beretta ..... 442/1

FOREIGN PATENT DOCUMENTS

| | | |
|---|---|---|
| EP | 0394293 | 5/1994 |
| EP | 0802280 | 10/1997 |
| WO | WO 98/12370 | 3/1998 |

OTHER PUBLICATIONS

Dictionary definition of "positive", The American Heritage® Dictionary of the English Language, Fourth Edition Copyright © 2004, 2000 by Houghton Mifflin Company, no month.*

* cited by examiner

PAPER MACHINE CLOTHING AND METHOD FOR ITS MANUFACTURE

FIELD OF THE INVENTION

The invention concerns a porous paper machine clothing for dewatering a paper web in a paper machine, in particular as a paper machine felt or dryer fabric, having a yarn layer made up of at least one ply of longitudinal yarns and at least one ply of transverse yarns crossing the longitudinal yarns.

Porous paper machine clothings are long and wide belts which circulate in various sections of a paper machine and on which the paper web is transported through the paper machine. In the first, so-called sheet-forming section, a fiber pulp is applied onto the paper machine clothing, causing a web of fibrous material to form. This is dewatered through the paper machine clothing. The paper machine clothing comprises a textile yarn structure which is sufficiently porous that the liquid coming out of the web of fibrous material is carried off through the paper machine clothing in response to gravity and vacuum. In the subsequent press section, the paper web and paper machine clothing are passed through roller presses so that the liquid still present in the paper web is pressed out through the paper machine clothing. As a rule, the paper machine clothing is embodied as a felt having a substrate made of a textile yarn structure. In the subsequent drying section, the paper web and paper machine clothing are guided over heated rollers, causing further dewatering—or, more accurately in this case, drying. Once again, paper machine clothings (i.e. dryer fabrics) made up of yarn structures are preferably used in the drying section; these are once again porous so that vapor can escape through the pores.

The textile yarn structures are embodied principally as woven fabrics. Also known, in addition, are so-called yarn layers, in which the yarns are not engaged into one another, i.e. are not interwoven or meshed with one another. U.S. Pat. No. 3,097,413 discloses one such paper machine clothing. It has a yarn layer made up of one ply of longitudinal yarns that extend parallel to and at a distance from one another and are not connected to one another. Applied onto the ply is a nonwoven fabric that encloses the longitudinal yarns and is needled to them.

A paper machine clothing of this kind has only a little transverse strength, however. For that reason, a transition has been made to combining the longitudinal yarn ply with a transverse yarn ply (DE-A-1 802 560; EP-B-0 394 293). Here modules comprising a yarn ply and a needled-on nonwoven fabric are first formed, and those modules are brought together and needled again. This manufacturing approach is not suitable for paper machine clothings made of only one yarn structure. For that situation, U.S. Pat. No. 4,555,440 proposes connecting the individual yarn plies to one another with binding threads.

In the paper machine clothings of the species described above, resistance to displacement between the individual plies in particular, and thus the dimensional stability, is unsatisfactory. If binding threads are used, these represent foreign elements and greatly complicate the manufacturing process. To eliminate these disadvantages, U.S. Pat. No. 5,888,915 proposes laying the plies of longitudinal and transverse yarns directly onto one another and fusing them together at the crossing points by heating. A prerequisite for this, however, is that bicomponent yarns be used in which the yarn core has a higher melting temperature than the yarn sheath. Fusing is accomplished by heating to a temperature above the melting point of the yarn sheath and below the melting point of the yarn core.

The dimensional stability of the paper machine clothing is improved because of the direct connection of the yarns of the individual plies. It is disadvantageous, however, that special yarns, namely bicomponent yarns, must be used; these are expensive and their material properties cannot always be optimally adjusted to conditions in the respective section of the paper machine.

SUMMARY OF THE INVENTION

It is the object of the invention to configure a paper machine clothing having a yarn layer in such a way that high dimensional stability can be obtained therewith regardless of the type of yarn, and so that it is suitable for all sections of a paper machine. A second object is to make available a method for its manufacture.

The first object is achieved, according to the present invention, by the fact that the longitudinal and transverse yarns are connected positively to one another at crossing points, in which context each connection can comprise an orifice in the one yarn and a projection fitting thereinto on the crossing yarn, or mutually aligned orifices at the crossing points and pegs, e.g. studs or rivets made of plastic or metal, passed through them. The invention thus creates the possibility of effecting a direct connection between the longitudinal and transverse yarns at the crossing points, regardless of the material of the yarns. There is thus no further need to resort to bicomponent yarns (although the basic idea of the invention also encompasses such yarns), but instead single-component yarns can be connected directly to one another.

The result is to make available for the first time a paper machine clothing having a yarn layer that is distinguished by excellent dimensional stability and—when single-component yarns are used—low manufacturing costs. "Single-component yarns" are understood here to mean those yarns that homogeneously comprise one material; that material can also be a copolymer, provided homogeneity exists.

The paper machine clothing according to the present invention has the advantage over woven and knitted fabrics of greater flexibility in terms of the number of plies, yarn density, and material selection. Manufacture also does not require complex textile machinery such as looms and knitting machines, which moreover limit the width of the paper machine clothing that can be produced on them. Such a limitation does not exist with yarn layers; in other words, they can be manufactured in practically any width. In addition, with yarn layers it is possible to dispense with the thermosetting operation necessary with woven fabrics, if the yarns have previously been adequately heat-treated.

An embodiment of the invention provides for an adhesive additionally to be present at the crossing points that are to be connected. An adhesive of this kind contributes to the immobilization of the longitudinal and transverse yarns at the crossing points. In addition, the adhesive can adhesively bond the parts engaging positively into one another, for example the orifices and projections or pegs. Suitable adhesives are hot-melt adhesives whose melting temperature is less than that of the yarns, contact is adhesives, diffusion adhesives, and/or reaction adhesives.

Immobilization at the crossing points can be improved by the fact that the longitudinal and transverse yarns and/or the parts connecting them, e.g. the pegs and orifices, are additionally fused to one another at crossing points as a result of heating confined to those crossing points. The temperature of the remaining regions of the yarns remains below the melting point of the yarn material. It therefore undergoes no change in structure or shape, so that the overall yarn structure defined by the superposition of the plies is retained.

It is particularly preferred to configure the longitudinal and transverse yarns as flat yarns having a rectangular cross section. The result is to create a planar contact at the crossing points, and the area over which the yarns can be fused to one another is considerably increased and therefore stronger. The yarn shape furthermore promotes formation of the positive connection. A range from 2 to 20 mm, preferably 8 to 12 mm, has proven advantageous as the width for the longitudinal and transverse yarns. The thickness should be between 0.3 and 2 mm, preferably 0.6 to 1.2 mm, and the transverse yarns should have, at maximum, the same thickness as the longitudinal yarns.

In order to guarantee sufficient permeability for water or vapor, especially with very wide flat yarns, passthrough openings can be provided in the longitudinal and/or transverse yarns. The permeability can be controlled as desired by way of their size and number; the possibility also exists of configuring the permeability differently over the width of the paper machine clothing, e.g. greater at the center than in the edge regions, or vice versa. The passthrough openings can be embodied as round holes or as oblong slots.

The paper machine clothing according to the present invention can have any desired number of plies, such that a ply having longitudinal yarns and a ply having transverse yarns alternate respectively, i.e. are in each case adjacent to one another. An advantageous number is two or three plies; in the former case a lower longitudinal yarn layer is combined with an upper transverse yarn layer, and in the latter case a ply having transverse yarns is enclosed on each side by a ply of longitudinal yarns. A longitudinal structure is formed thereby on the upper and lower sides. The possibility of course exists of proceeding conversely, so that a transverse structure is created on the upper and the lower side by the transverse yarns present there.

The permeability of the paper machine clothing can also be adjusted within wide limits, for example, by way of the width dimensions of the longitudinal and/or transverse yarns and/or their yarn density. It is also possible in this context to arrange the longitudinal yarns, in at least one ply, in such a way that they have a different yarn density in the center region than in the edge regions, in particular have a lower density in the center region than in the edge regions.

With the yarn layer according to the present invention it is also possible, in simple fashion, to produce eyelets at the ends of the paper machine clothing by bending back longitudinal yarns to constitute loops, so as to form an inserted wire seam with them. This can be done as follows: at the ends of the paper machine clothing, end pieces of longitudinal yarns of a first ply are bent back, forming loops, onto the side facing away from that ply of the ply having transverse yarns, and are attached to several of those transverse yarns, preferably to at least five transverse yarns. Attachment can also, however, be performed to the longitudinal yarns themselves. Attachment can be accomplished in both cases in positive fashion, e.g. by means of studs or rivets made of plastic or metal.

The loops should preferably be formed with only a portion of the longitudinal yarns, so that the two end edges can engage into each other in comb fashion with their loops and thus form a continuous conduit for an inserted wire. It is preferable if alternately at least one end piece is bent back to form a loop, and at least one end piece ends at the outer transverse yarn edge without forming a loop. To ensure that permeability in this region is not degraded, longitudinal yarns from the second ply in contact against the ply having transverse yarns should be adjacent against the ends of the end pieces, i.e. these longitudinal yarns butt in blunt fashion against the end pieces so that they do not overlap them, so that a greater density of longitudinal yarns does not occur in this region.

As regards the material of the yarns, there are fundamentally no limitations: it should possess high tensile strength, low elongation, and a high initial modulus. PET, PA in all its modifications, PPS, PEK, PEKK, elastic polyester, PBT or PTT, or combinations thereof, are, for example, suitable. The yarns can be reinforced, e.g. with fibers such as glass fibers, carbon fibers, and/or ceramic fibers; the fibers can also be present as short-cut fibers.

The paper machine clothing according to the present invention can be used in every section of a paper machine, and because of its flexibility can be optimally adapted to the requirements in each of these sections. For use in the sheet-forming and drying sections, the most suitable embodiments are those in which the paper machine clothing comprises only the yarn layer; this does not exclude combining the yarn layer with other components, for example a nonwoven fabric. For the press section, it is recommended to use the yarn layer according to the present invention as a substrate and to equip it on one or both sides with a fiber layer, for example applying nonwoven fabrics or spunbonded fabrics by needling or lamination.

For manufacturing the paper machine clothing described above, the invention proposes a method in which the longitudinal and transverse yarns are connected positively to one another at the crossing points, for example by mutual engagement in each case of a projection on the one yarn and a complementary orifice on the crossing yarn, or by insertion of a peg, for example a stud or a rivet, into mutually aligning orifices in the yarns.

The connection between the yarns can be further improved by the fact that the longitudinal and transverse yarns are fused at crossing points to one another and/or to connecting elements by a heating operation to melting temperature that is confined to the crossing points, the heating being accomplished by way of laser energy, high-frequency energy, and/or inductive energy. It is possible here to use two alternative methods with which heating can be concentrated onto the crossing points. On the one hand, the energy can be applied in single-point fashion, i.e. in a manner physically confined to the crossing points, for which purpose lasers are especially suitable because of their focused laser beam. As an alternative to this, however, the energy can also be applied in wide-area fashion over a plurality of crossing points to be fused, for example over the entire width and a certain length of the paper machine clothing, if the crossing points are previously equipped with an additive that promotes energy absorption. As a result of this additive, energy uptake is concentrated on the crossing points in spite of the wide-area application, so that only those points are heated to melting temperature and consequently are fused to one another. Wide-area energy application is easier to implement in terms of apparatus, since there is no need to focus onto the plurality of crossing points to be connected.

The additive usable in each case should be adapted to the type of energy application. If a laser, for example a diode laser, is used, the additive should be a light-absorbing colorant, e.g. black dye, or a photoactive substance, the yarns located thereabove being transparent. For the utilization of high-frequency or inductive energy, metals, and in this case principally powdered iron, which can be present in the form of a paste, dispersion, or powder, are especially suitable. The additive can be applied between or onto the yarns, application only onto the yarns of one ply of each pair of adjacent plies being sufficient in the latter case. Instead of application at a later time, the additive can also be added to the yarn material in single-point fashion, e.g. during the extrusion operation.

According to a further feature of the invention, it is proposed that the longitudinal and transverse yarns be additionally connected to one another at crossing points by using an adhesive. Connection at the crossing points is thereby further strengthened.

Manufacture of the yarn layer can be accomplished specifically by first stretching longitudinal yarns parallel to one another, for example between two parallel yarn trees, and then laying transverse yarns, individually or in groups, successively onto these longitudinal yarns and connecting the transverse and longitudinal yarns positively to one another at the crossing points, for example by inserting connecting studs into holes that align at the crossing points, or by pushing a projection on the one yarn into a complementary orifice in the other yarn.

In order to achieve even better connection of the yarns at the crossing points, the yarn layer can be continuously transported in the longitudinal direction through a fusing apparatus and then rolled up. Simultaneously or later, transverse yarns can also be attached onto the other side of the longitudinal yarns. It is understood that a ply having longitudinal yarns can also in turn be applied in corresponding fashion onto the exposed side of the transverse yarns.

The invention further provides that after fusing at the crossing points, the plies are pressed against one another for a time until the connection has hardened and cooled.

If a felt is to be produced, for example for use in the press section of a paper machine, a fiber layer should be applied onto one or both sides of the yarn layer and attached thereto. Attachment can be effected by needling, adhesive bonding, or fusing.

It is understood that the transverse yarns need not extend perpendicular to the longitudinal yarns, but rather that with the method according to the present invention it is also possible to manufacture yarn layers in which the transverse yarns extend obliquely with respect to the longitudinal yarns. It is also possible to provide two plies of transverse yarns, in which the transverse yarns of the one ply cross the longitudinal yarns at a different angle than those of the other ply.

DESCRIPTION OF THE DRAWINGS

The invention is illustrated in further detail, with reference to exemplary embodiments, in the drawings, in which.

DETAILED DESCRIPTION OF THE PREFERRED EMBODIMENTS

Figure 1:
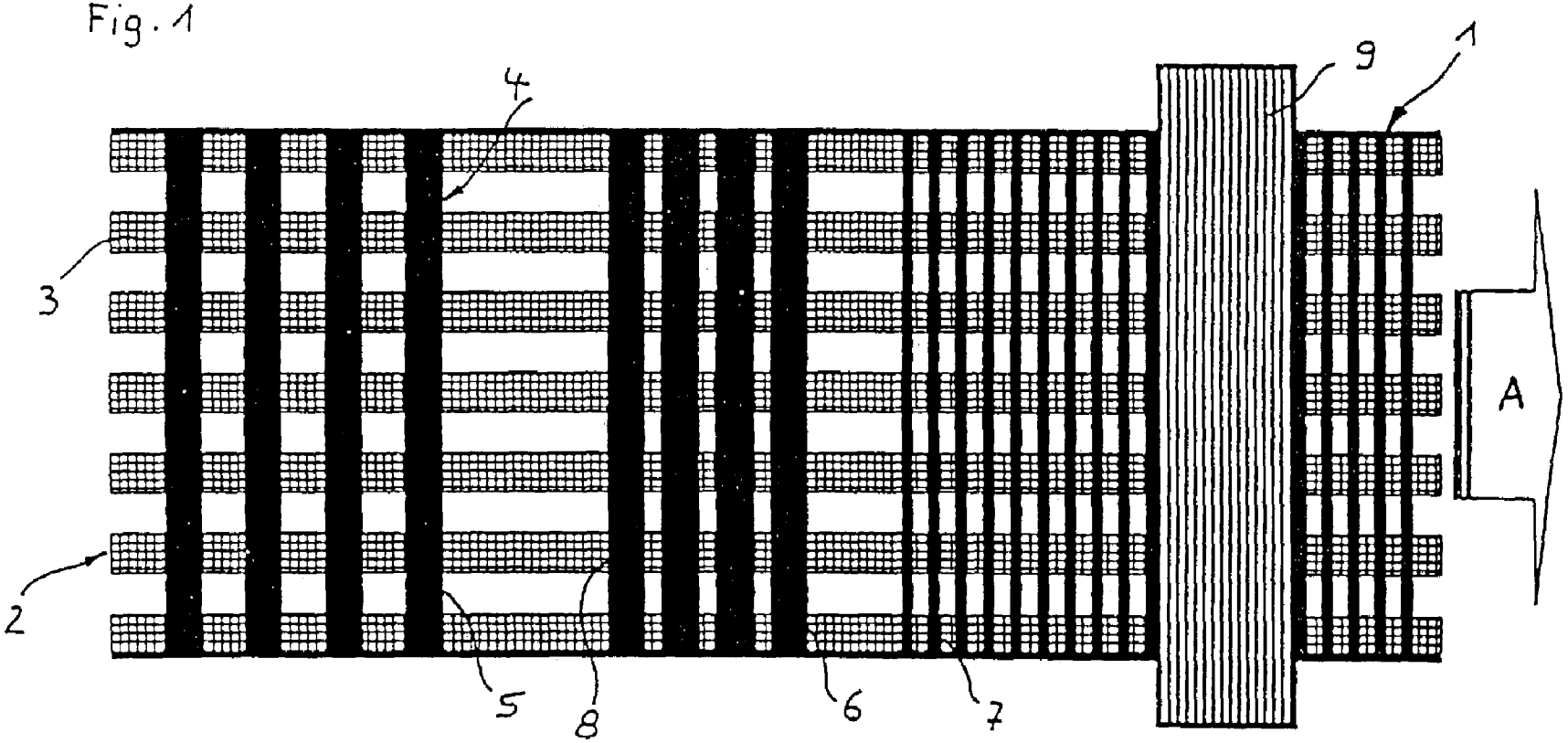
FIG. 1 is a plan view of a schematically depicted paper machine clothing with a fusing apparatus.
Figure 2:
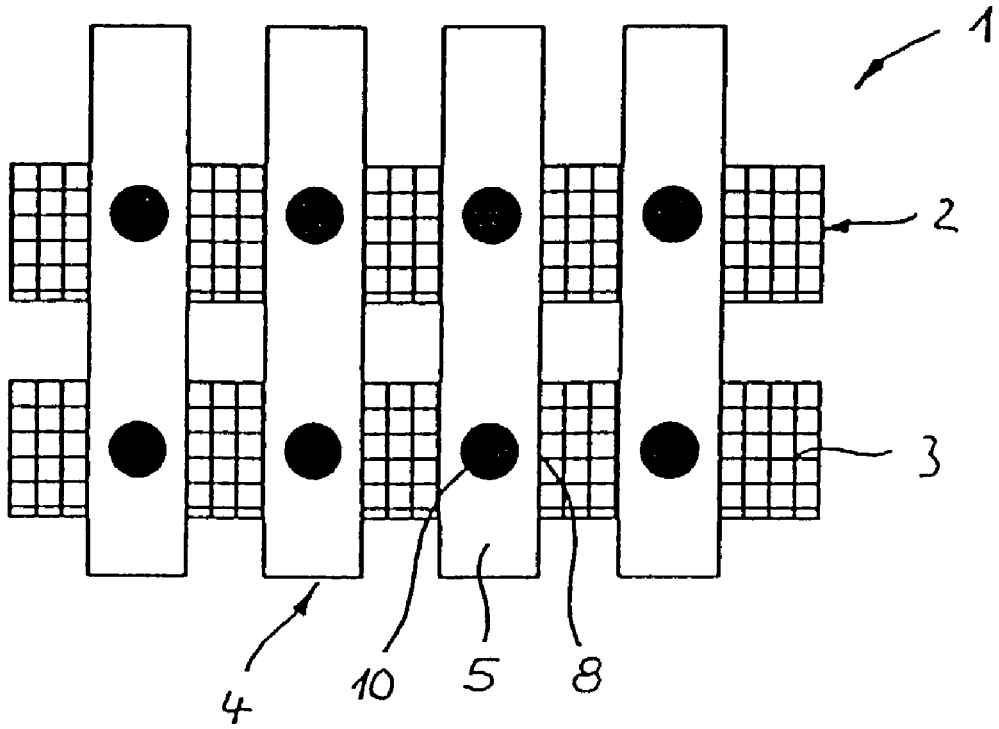
FIG. 2 is an magnified plan view of a portion of the paper machine clothing according to FIG. 1.
Figure 3:
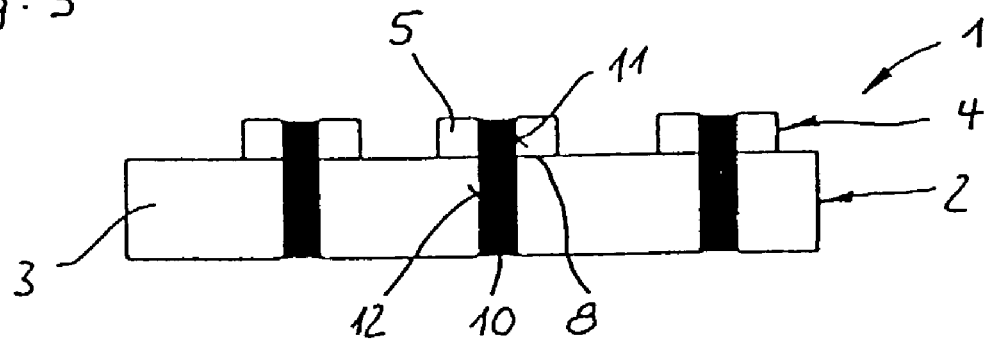
FIG. 3 is a partial cross section through the paper machine clothing according to FIGS. 1 and 2.

Paper machine clothing 1 depicted in FIG. 1 comprises a yarn layer whose lower ply 2 is constituted by longitudinal yarns (labeled 3 by way of example). Longitudinal yarns 3 have a rectangular cross section and equal spacing from one another. For the manufacturing process, they are wound with their left ends (in a manner not visible here) onto a yarn tree. Provided on the right side (and also not visible here) is a second tree onto which the finished paper machine clothing 1 is wound. Paper machine clothing 1 moves in this direction (arrow A).

An upper ply 4 having transverse yarns parallel to one another (labeled 5, 6, 7 by way of example) is laid onto lower ply 2. Transverse yarns 5 have a wide spacing corresponding substantially to the spacing of longitudinal yarns 3, transverse yarns 6 have a narrow spacing in order to reduce the permeability of paper machine clothing 1, and transverse yarns 7 also have a narrow spacing but a substantially narrower width than transverse yarns 5, 6. It is understood that in an actual paper machine clothing these differences are not present, i.e. identical transverse yarns, equally spaced from one another, are used. The depiction is intended merely to symbolize the fact that the method according to the present invention makes possible a very wide variety of types of longitudinal and transverse yarns 3, 5, 6, 7 and yarn densities. The same applies to longitudinal yarns 3, the additional possibility existing here of varying their spacings across the width, e.g. providing a lower yarn density in the center region than in the two edge regions, or vice versa.

FIGS. and 3 show portions of paper machine clothing 1 according to FIG. 1. At the crossing points (labeled 8 by way of example), longitudinal and transverse yarns 3, 5 are connected positively to one another, specifically by way of connecting studs (labeled 10 by way of example) that each pass through mutually aligned holes (labeled 11, 12 by way of example) in longitudinal and transverse yarns 3, 5. Instead of this, however, connecting studs 10 can also be shaped onto longitudinal yarns 3 or transverse yarns 5, so that only the respective other yarns need to have holes into which the connecting studs are then pressed.

For the manufacture of paper machine clothing 1, longitudinal yarns 3 are stretched between the two trees and transverse yarns 5, 6, 7 are then laid over longitudinal yarns 3. This can be done in mechanized fashion, for example using a transverse table apparatus whose principle is known from U.S. Pat. No. 3,097,413. Longitudinal and transverse yarns 3, 5, 6, 7 are then connected positively by inserting connecting studs 10 into holes 11, 12 that align at crossing points 8. For additional immobilization, longitudinal and transverse yarns 3, 5, 6, 7 are adhesively bonded to one another at crossing points 8. Adhesive can be applied onto longitudinal and/or transverse yarns 3, 5, 6, 7 either in single-point fashion or over an area.

A fusing apparatus 9 spans paper machine clothing 1 like a bridge. Its purpose is to cause the material of longitudinal and transverse yarns 3, 5, 6, 7, and of connecting studs 10, to melt at crossing points 8 so that they fuse to one another there. Laser, high-frequency, and/or induction apparatuses are suitable as the fusing apparatus. To ensure that the melting of the material of longitudinal yarns 3 and transverse yarns 5, 6, 7 remains confined to crossing points 8, an additive has been applied to crossing points 8 that promotes absorption of the energy generated in fusing apparatus 9. The energy impingement is then adjusted so that longitudinal and transverse yarns 3, 5, 6, 7 melt only at crossing points 8 because of the additive present there, and consequently fuse to one another and/or to connecting studs 10, while the other portions of longitudinal and transverse yarns 3, 5, 6, 7 are heated either not at all or only slightly, and in any event not to melting temperature. After leaving fusing apparatus 9, crossing points 8 cool off so that the molten regions harden and a permanent connection is created between longitudinal and transverse yarns 3, 5, 6, 7. This can be further promoted by pressing the two plies 2, 4 together, for example using rollers or plates that are carried along as paper machine cloth 1 moves.

If connecting studs 10 fit very tightly into holes 11, 12, the positive connection may also be sufficient, and a subsequent fusing process is then not necessary.

Figure 4:
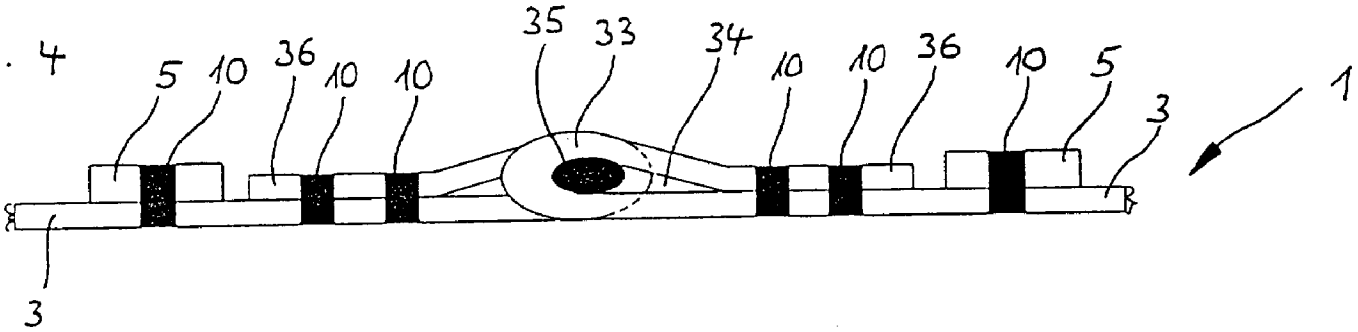
FIG. 4 is a side view of the seam region of the paper machine clothing according to FIGS. 1 through 3.
Figure 5:
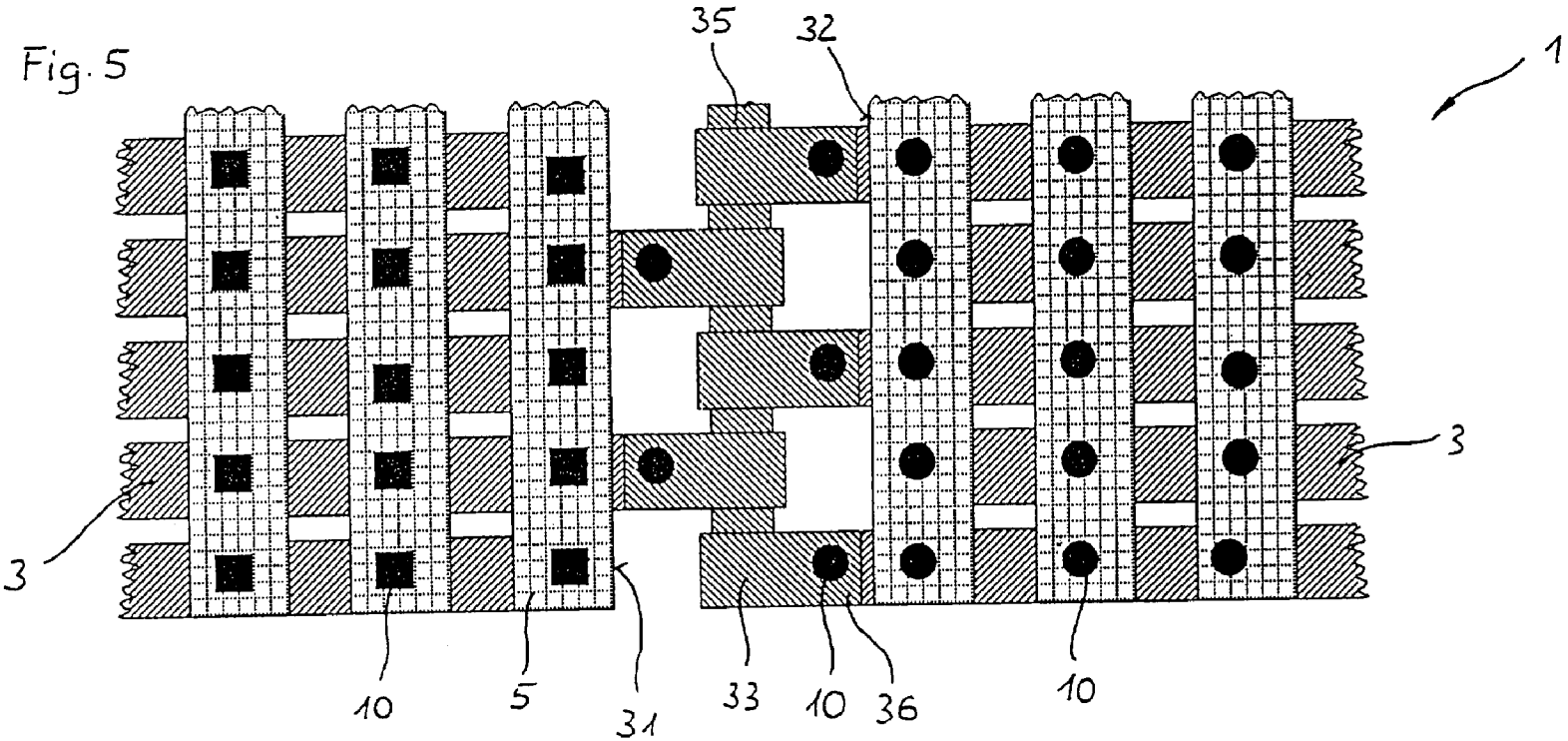
FIG. 5 is a plan view of the seam region of the paper machine clothing according to FIGS. 1 through 3.

In FIGS. 4 and 5, the end regions of paper machine clothing 1 are depicted partially, i.e. reduced in width to five longitudinal yarns 3. Transverse yarns 5 are connected via connecting studs 10 to longitudinal yarns 3; on the left side, connecting studs 10 that are square in cross section were used, and on the right side connecting studs 10 that are round in cross section. This depiction is provided solely in order to demonstrate that different cross sections can be used for connecting studs 10. Connecting studs 10 that all have the same cross-sectional shape will usually be used in a paper machine clothing 1.

At both ends 31, 32 of paper machine clothing 1, every second longitudinal yarn 3 protrudes in such a way that longitudinal yarns 3 of the two ends 31, 32 engage into one another in comb fashion, i.e. wherever a longitudinal yarn 3 projects at the one end 31, that longitudinal yarn 3 does not project at the other end 32, so that a gap is created for the portion of longitudinal yarn 3 projecting at end 31. The projecting portions of longitudinal yarns 3 are looped over and back to form loops (labeled 33 by way of example). They thereby form loop openings (labeled 34 by way of example) that all align with one another and thereby form a conduit through which a coupling wire 35 is inserted. This coupling wire 35 connects ends 31, 32 of paper machine 1, thus yielding an endless paper machine clothing 1. Paper machine clothing 1 can be opened again by pulling out coupling wire 35, for example in order to pull paper machine clothing 1 into a paper machine or remove it therefrom.

As is evident in particular from FIG. 5, the turned-over loop ends (labeled 36 by way of example) are laid back down onto the associated longitudinal yarns 3 and joined to it via connecting studs 10 in the same way that transverse yarns 5 are joined to longitudinal yarns 3. FIG. 4 illustrates a connection of loop ends 36 using two connecting studs 10 in each case, but FIG. 5 illustrates the use of only one connecting stud 10. The variant according to FIG. 4 is suitable for transferring particularly large tensile forces.

Figure 6:
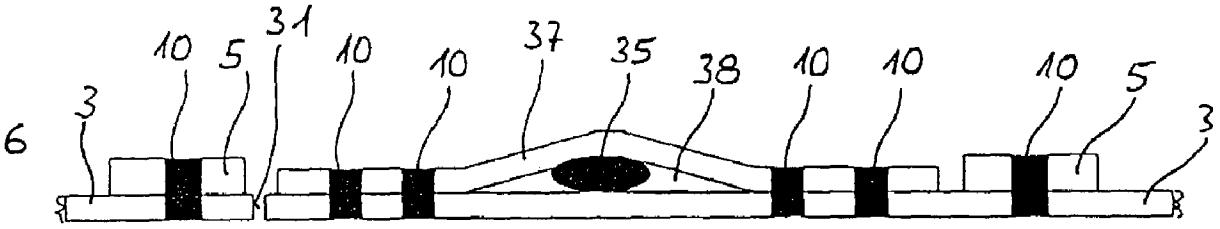
FIG. 6 is a longitudinal section through the seam region of the paper machine clothing according to FIGS. 1 through 3, showing the prolongation of a longitudinal yarn beyond the right end of the paper machine clothing.
Figure 7:
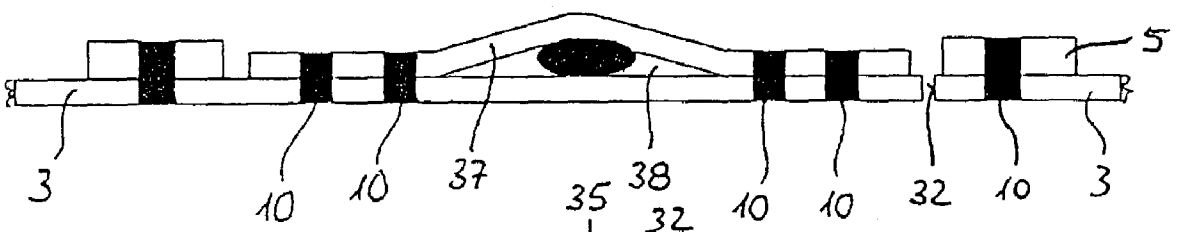
FIG. 7 is a cross section through the seam region of the paper machine clothing according to FIGS. 1 through 3, showing the prolongation of a longitudinal yarn beyond the left end of the paper machine clothing according to FIGS. 1 through 3.
Figure 8:
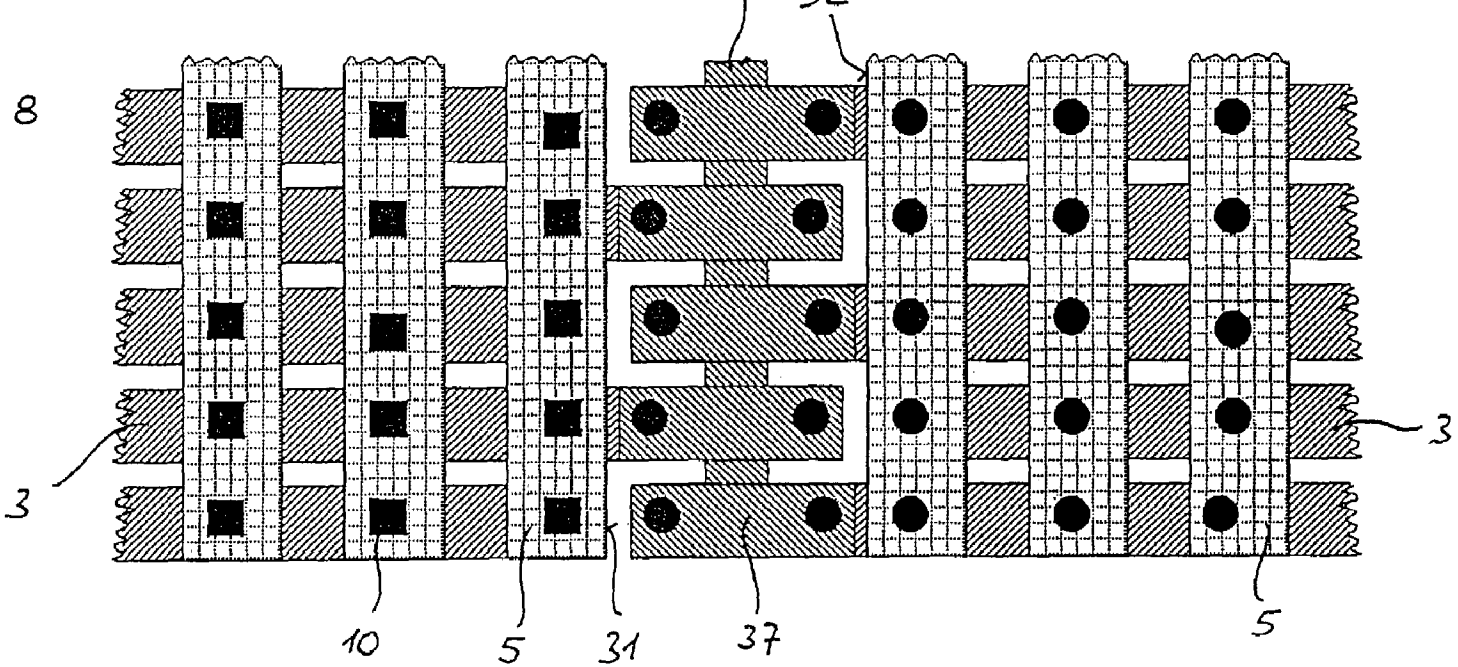
FIG. 8 is a plan view of the seam region of the paper machine clothing according to FIGS. 1 through 3, which differs from the embodiment of FIGS. 4 and 5.

In the exemplary embodiment according to FIGS. 6 through 8, paper machine clothing 1 has a form of connection of ends 31, 32 that differs from the embodiment according to FIGS. 4 and 5. Longitudinal yarns 3 are prolonged in the same way as in the embodiment according to FIGS. 4 and 5, i.e. they engage in comb fashion into one another. They are not, however, turned back to form loops; instead they extend out flat and end in the vicinity of transverse yarns 5 of the respective other end 31 or 32.

Yarn strips (labeled 37 by way of example) are laid onto the projecting portions of longitudinal yarns 3 in such a way that mutually aligning openings 38 are produced. Coupling wire 35 is inserted through these openings 38. On either side of coupling wire 35, yarn strips 37 are connected to the projecting portions of longitudinal yarns 3 by means of connecting studs 10. In the variant shown in FIGS. 6 and 7, four connecting studs 10—two on either side of coupling wire 35—are used for this in each case, so that large loads can be handled. If the loads are smaller, two connecting studs 10—one on either side of coupling wire 35—are sufficient in each case, as depicted in FIG. 8.

I claim:

1. A porous paper machine clothing for dewatering a paper web in a paper machine, comprising:

a non-interwoven porous paper machine clothing having at least first and second yarn layers, said first yarn layer made up of at least one ply of longitudinal yarns, said second yarn layer made up of at least one ply of transverse yarns adjacent and contacting said longitudinal yarns at crossing points, at least one of said longitudinal and transverse yarns having orifices at said crossing points, a plurality of connecting elements, each of said connecting elements having a first end secured to one of said yarns at a corresponding one of said crossing points and a second end secured within a corresponding one of said orifices, so that said longitudinal and transverse yarns are locked positively to one another at said crossing points.

2. The paper machine clothing as defined in claim 1, wherein an adhesive is additionally present at the crossing points (8) that are to be connected.

3. The paper machine clothing as defined in claim 2, wherein the adhesive is a hot-melt adhesive, contact adhesive, diffusion adhesive, and/or reaction adhesive.

4. The paper machine clothing as defined in claim 1, wherein the longitudinal and transverse yarns and the plurality of connecting elements are additionally fused to one another at crossing points as a result of heating confined to those crossing points.

5. The paper machine clothing as defined in claim 1, wherein the longitudinal and transverse yarns are configured as flat yarns having a rectangular cross section.

6. The paper machine clothing as defined in claim 5, wherein the longitudinal and transverse yarns have a width from 2 to 20 mm.

7. The paper machine clothing as defined in claim 1, wherein the longitudinal yarns (3) have a different width in the center region than in the edge regions.

8. The paper machine clothing as defined in claim 5, wherein the longitudinal and transverse yarns have a height of 0.3 to 2 mm.

9. The paper machine clothing as defined in claim 1, wherein the transverse yarns (5, 6, 7) have, at maximum, the same thickness as the longitudinal yarns (3).

10. The paper machine clothing as defined in claim 1, wherein the longitudinal and/or transverse yarns have passthrough openings.

11. The paper machine clothing as defined in claim 1, wherein at least three plies are present, a ply having longitudinal yarns and a ply having transverse yarns being adjacent to each other.

12. The paper machine clothing as defined in claim 11, wherein a ply having transverse yarns is enclosed on each side by a ply of longitudinal yarns.

13. The paper machine clothing as defined in claim 1, wherein at least one ply having longitudinal yarns has a different yarn density in the center region than in the edge regions.

14. The paper machine clothing as defined in claim 1, wherein at the ends of the paper machine clothing (1), end pieces of longitudinal yarns (3) are bent back to form loops and attached.

15. The paper machine clothing as defined in claim 14, wherein the end pieces are bent back onto the side of the ply (4) having transverse yarns (5, 6, 7) that faces away from the ply (2) having the longitudinal yarns (3), and are attached to transverse yarns (5, 6, 7).

16. The paper machine clothing as defined in claim 14, wherein end pieces of longitudinal yarns (3) of one ply (2) are bent back at the ends of the paper machine clothing (1) to form loops, and are attached to themselves.

17. The paper machine clothing as defined in claim 14, wherein non-loop-forming end pieces of longitudinal yarns (3) are each attached to the last transverse yarn (5, 6, 7) at the end of the paper machine clothing (1).

18. The paper machine clothing as defined in claim 14, wherein alternatingly at least one end piece is bent back to form a loop, and at least one end piece ends at the outer edge of the last transverse yarn (5, 6, 7) at the end of the paper machine clothing (1).

19. The paper machine clothing as defined in claim 14, wherein longitudinal yarns of a second ply having longitudinal yarns, which is in contact against the ply having transverse yarns, are adjacent to the ends of the end pieces.

20. The paper machine clothing as defined in claim 14, wherein the longitudinal and/or transverse yarns (3, 5, 6, 7) are made of PET, PA in all its modifications, PPS, PEK, PEKK, elastic polyester, PBT or PTT, or combinations thereof.

21. The paper machine clothing as defined in claim 1, wherein the longitudinal and/or transverse yarns (3, 5, 6, 7) are fiber-reinforced.

22. The paper machine clothing as defined in claim 1, wherein a fiber ply is provided on at least one side.

23. The paper machine clothing as defined in claim 5, wherein the longitudinal and transverse yarns have a width from 8 to 12 mm.

24. The paper machine clothing of claim 5, wherein the longitudinal and transverse yarns have a height of 0.6 to 1.2 mm.

* * * * *